US010162294B2

(12) United States Patent
Namekata et al.

(10) Patent No.: US 10,162,294 B2
(45) Date of Patent: Dec. 25, 2018

(54) FIXING DEVICE AND IMAGE FORMING APPARATUS TO ADJUST ROTATIONAL SPEED OF ROTATOR DUE TO THERMAL EXPANSION

(71) Applicants: Shinichi Namekata, Kanagawa (JP); Naoto Suzuki, Kanagawa (JP); Yohhei Watanabe, Kanagawa (JP); Takashi Sakamaki, Kanagawa (JP); Teppei Kawata, Kanagawa (JP); Masateru Ujiie, Kanagawa (JP)

(72) Inventors: Shinichi Namekata, Kanagawa (JP); Naoto Suzuki, Kanagawa (JP); Yohhei Watanabe, Kanagawa (JP); Takashi Sakamaki, Kanagawa (JP); Teppei Kawata, Kanagawa (JP); Masateru Ujiie, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/604,260

(22) Filed: May 24, 2017

(65) Prior Publication Data

US 2017/0357198 A1 Dec. 14, 2017

(30) Foreign Application Priority Data

Jun. 13, 2016 (JP) ..... 2016-117158

(51) Int. Cl.
*G03G 15/20* (2006.01)

(52) U.S. Cl.
CPC ..... *G03G 15/2085* (2013.01); *G03G 15/2053* (2013.01); *G03G 15/206* (2013.01);
(Continued)

(58) Field of Classification Search
CPC ..... G03G 15/2085; G03G 15/2028; G03G 15/657; G03G 2215/00156;
(Continued)

(56) References Cited

U.S. PATENT DOCUMENTS

2009/0274496 A1 11/2009 Okamoto et al.
2010/0303521 A1* 12/2010 Ogawa ..... G03G 15/2007 399/323

(Continued)

FOREIGN PATENT DOCUMENTS

JP 08095422 A * 4/1996
JP 09190105 A * 7/1997

(Continued)

OTHER PUBLICATIONS

U.S. Appl. No. 15/384,211, filed Dec. 19, 2016.

*Primary Examiner* — Robert Beatty
(74) *Attorney, Agent, or Firm* — Duft & Bornsen, PC

(57) ABSTRACT

A fixing device includes an endless belt, a drive rotator, a driven rotator, a rotation detector, and circuitry. The drive rotator contacts and rotates the endless belt. The driven rotator contacts an inner circumferential surface of the endless belt. The rotation detector detects a rotational speed of the driven rotator. The circuitry is operatively connected to the rotation detector to control a rotational speed of the drive rotator based on the rotational speed of the driven rotator detected by the rotational detector. The circuitry changes the rotational speed of the drive rotator when a recording medium bearing a toner image is not conveyed over the endless belt.

18 Claims, 9 Drawing Sheets

(52) U.S. Cl.
CPC ..... *G03G 15/2028* (2013.01); *G03G 2215/00413* (2013.01); *G03G 2215/2032* (2013.01); *G03G 2215/2045* (2013.01)

(58) Field of Classification Search
CPC ..... G03G 2215/00413; G03G 2215/00746; G03G 2215/2016; G03G 2215/2045
USPC ..... 399/68, 329; 219/216
See application file for complete search history.

(56) References Cited

U.S. PATENT DOCUMENTS

| | | | | |
|---|---|---|---|---|
| 2011/0229161 | A1* | 9/2011 | Ueno | G03G 15/205 399/33 |
| 2011/0311249 | A1 | 12/2011 | Kubota et al. | |
| 2012/0045226 | A1 | 2/2012 | Hase et al. | |
| 2013/0195477 | A1 | 8/2013 | Seshita et al. | |
| 2013/0195493 | A1 | 8/2013 | Hase et al. | |
| 2013/0209115 | A1 | 8/2013 | Hase et al. | |
| 2013/0209120 | A1 | 8/2013 | Namekata et al. | |
| 2013/0209121 | A1 | 8/2013 | Uchitani et al. | |
| 2013/0251390 | A1 | 9/2013 | Ishii et al. | |
| 2014/0064804 | A1 | 3/2014 | Yamaguchi et al. | |
| 2014/0112680 | A1 | 4/2014 | Ueno et al. | |
| 2014/0119762 | A1 | 5/2014 | Suzuki et al. | |
| 2014/0270824 | A1 | 9/2014 | Satoh et al. | |
| 2014/0369703 | A1 | 12/2014 | Hase et al. | |
| 2015/0227095 | A1 | 8/2015 | Uchitani et al. | |
| 2015/0234329 | A1 | 8/2015 | Hase et al. | |
| 2016/0054691 | A1 | 2/2016 | Hase et al. | |
| 2016/0098003 | A1 | 4/2016 | Uchitani et al. | |
| 2016/0124342 | A1 | 5/2016 | Yamaguchi et al. | |
| 2016/0363898 | A1 | 12/2016 | Ujiie | |

FOREIGN PATENT DOCUMENTS

| | | | |
|---|---|---|---|
| JP | 2002-072751 | | 3/2002 |
| JP | 2004020689 | A * | 1/2004 |
| JP | 2012-013821 | | 1/2012 |
| JP | 2014137542 | A * | 7/2014 |
| JP | 2016-136225 | | 7/2016 |

* cited by examiner

FIXING DEVICE AND IMAGE FORMING APPARATUS TO ADJUST ROTATIONAL SPEED OF ROTATOR DUE TO THERMAL EXPANSION

CROSS-REFERENCE TO RELATED APPLICATION

This patent application is based on and claims priority pursuant to 35 U.S.C. § 119(a) to Japanese Patent Application No. 2016-117158, filed on Jun. 13, 2016, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

Such a fixing device may control a rotational speed a drive rotator that rotates an endless belt entrained around a driven rotator, based on a rotational speed of the driven rotator detected by a rotation detector.

SUMMARY

In one embodiment of the present disclosure, a novel fixing device is described that includes an endless belt, a drive rotator, a driven rotator, a rotation detector, and circuitry. The drive rotator contacts and rotates the endless belt. The driven rotator contacts an inner circumferential surface of the endless belt. The rotation detector detects a rotational speed of the driven rotator. The circuitry is operatively connected to the rotation detector to control a rotational speed of the drive rotator based on the rotational speed of the driven rotator detected by the rotational detector. The circuitry changes the rotational speed of the drive rotator when a recording medium bearing a toner image is not conveyed over the endless belt.

Also described is a novel image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
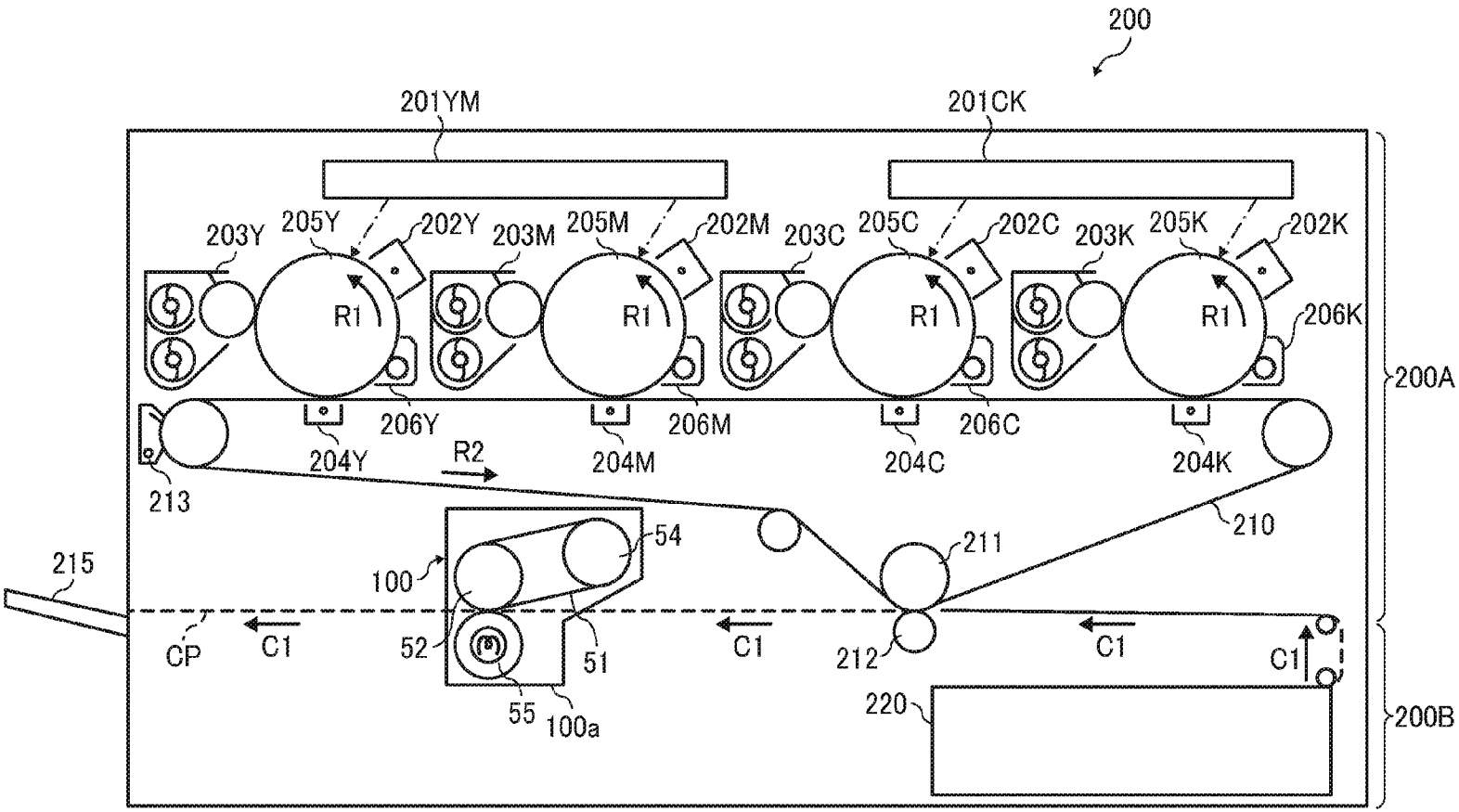
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and K denote colors yellow, magenta, cyan, and black, respectively. To simplify the description, these suffixes are omitted unless necessary.

Referring now to the drawings, embodiments of the present disclosure are described below.

Initially with reference to FIG. 1, a description is given of an image forming apparatus 200 according to an embodiment of the present disclosure.

FIG. 1 is a schematic view of the image forming apparatus 200.

The image forming apparatus 200 is a color printer employing a tandem structure in which a plurality of image forming devices for forming toner images in different colors is aligned in a direction in which a transfer belt is stretched. The image forming apparatus 200 forms color and monochrome toner images on a recording medium by electrophotography.

The image forming apparatus 200 is a high-speed machine that includes an image forming device 200A and a sheet feeder 200B. The image forming device 200A is located in an upper portion of a housing of the image forming apparatus 200. The sheet feeder 200B is located below the image forming device 200A. The image forming device 200A includes, e.g., a fixing device 100 and an intermediate transfer belt 210. The intermediate transfer belt 210 is located substantially in the center of the housing of the image forming apparatus 200 in a vertical direction in FIG. 1. Above the intermediate transfer belt 210 are photoconductors 205Y, 205M, 205C, and 205K surrounded by various pieces of equipment to form toner images of different colors having a complementary-color relationship with colors into which color data is decomposed. Specifically, the photoconductors 205Y, 205M, 205C, and 205K as image bearers to bear toner images of yellow, magenta, cyan, and black, respectively, are arranged side by side along a transfer face of the intermediate transfer belt 210 facing the photoconductors 205Y, 205M, 205C, and 205K.

The photoconductors 205Y, 205M, 205C, and 205K are drum-shaped photoconductors rotatable in a counter-clockwise direction of rotation R1 as illustrated in FIG. 1. The photoconductors 205Y, 205M, 205C, and 205K are surrounded by various pieces of equipment such as chargers 202Y, 202M, 202C, and 202K, developing devices 203Y, 203M, 203C, and 203K, primary transfer devices 204Y, 204M, 204C, and 204K, and photoconductor cleaners 206Y, 206M, 206C, and 206K, respectively.

The developing devices 203Y, 203M, 203C, and 203K contain toner of yellow, magenta, cyan, and black, respectively. Optical writing devices 201YM and 201CK are disposed in an uppermost portion of the image forming device 200A.

The intermediate transfer belt 210 is entrained around drive and driven rollers. The intermediate transfer belt 210 rotates in a clockwise direction of rotation R2 as illustrated in FIG. 1. That is, the intermediate transfer belt 210 and the photoconductors 205Y, 205M, 205C, and 205K rotate in the same direction where the intermediate transfer belt 210 meets the photoconductors 205Y, 205M, 205C, and 205K.

A secondary transfer roller 212 is disposed opposite a secondary transfer opposed roller 211 that is one of the driven rollers.

A conveyance passage CP, defined by internal components of the image forming apparatus 200, is a passage for conveying a sheet P as a recording medium. As illustrated in FIG. 1, the conveyance passage CP is a lateral passage in a substantially horizontal direction between the secondary transfer roller 212 and the fixing device 100.

The sheet feeder 200B includes a sheet tray 220 and a conveyance mechanism. A plurality of sheets P rests on the sheet tray 220. The conveyance mechanism picks up and conveys the plurality of sheets P one by one to a secondary transfer position between the secondary transfer opposed roller 211 and the secondary transfer roller 212 in a direction of conveying the sheet P (hereinafter referred to as a sheet conveyance direction C1).

To provide a fuller understanding of embodiments of the present disclosure, a description is now given of an image forming operation of the image forming apparatus 200 with continued reference to FIG. 1. For example, the charger 202Y uniformly charges the surface of the photoconductor 205Y to form an electrostatic latent image thereon according to image data from a scanner. The developing device 203Y develops the electrostatic latent image with yellow toner which the developing device 203Y accommodates, rendering the electrostatic latent image visible as a toner image of yellow. Thus, the toner image of yellow is formed on the surface of the photoconductor 205Y. The primary transfer device 204Y supplied with a predetermined bias primarily transfers the toner image of yellow from the surface of the photoconductor 205Y onto the intermediate transfer belt 210.

Similarly, toner images of magenta, cyan, and black are formed on the photoconductors 205M, 205C, and 205K, respectively, and primarily transferred onto the intermediate transfer belt 210. Thus, the toner images of yellow, cyan, magenta, and black are primarily transferred onto the intermediate transfer belt 210 from the photoconductors 205Y, 205M, 205C, and 205K in sequence by static electricity while being superimposed one atop another to form a composite toner image on the intermediate transfer belt 210.

The toner image is secondary transferred onto the sheet P, which is conveyed from the sheet tray 220, at the secondary transfer position between the secondary transfer opposed roller 211 and the secondary transfer roller 212. The sheet P bearing the toner image is conveyed to the fixing device 100. The fixing device 100 includes, e.g., a fixing belt 51, a pressure roller 55, a fixing roller 52, a heating roller 54, and a fixing cover 100*a*. In the fixing device 100, the toner image is fixed onto the sheet P while the sheet P is conveyed through an area of contact, herein referred to as a fixing nip N, between the fixing belt 51 and the pressure roller 55. Then, the sheet P is ejected from the fixing nip N. The sheet P bearing the fixed toner image is then conveyed to a stacker 215 along the sheet conveyance passage CP.

After the primary transfer of the toner images of yellow, magenta, cyan, and black onto the intermediate transfer belt 210, the photoconductor cleaners 206Y, 206M, 206C, and 206K remove residual toner from the photoconductors 205Y, 205M, 205C, and 205K, respectively. In this case, the residual toner is toner that has failed to be transferred onto the intermediate transfer belt 210 and therefore that remains on the photoconductors 205Y, 205M, 205C, and 205K. After the secondary transfer of the composite toner image onto the sheet P, a belt cleaner 213 removes residual toner from the intermediate transfer belt 210, rendering the intermediate transfer belt 210 ready for next image formation. In this case, the residual toner is toner that has failed to be transferred onto the sheet P and therefore that remains on the intermediate transfer belt 210.

Figure 2A:
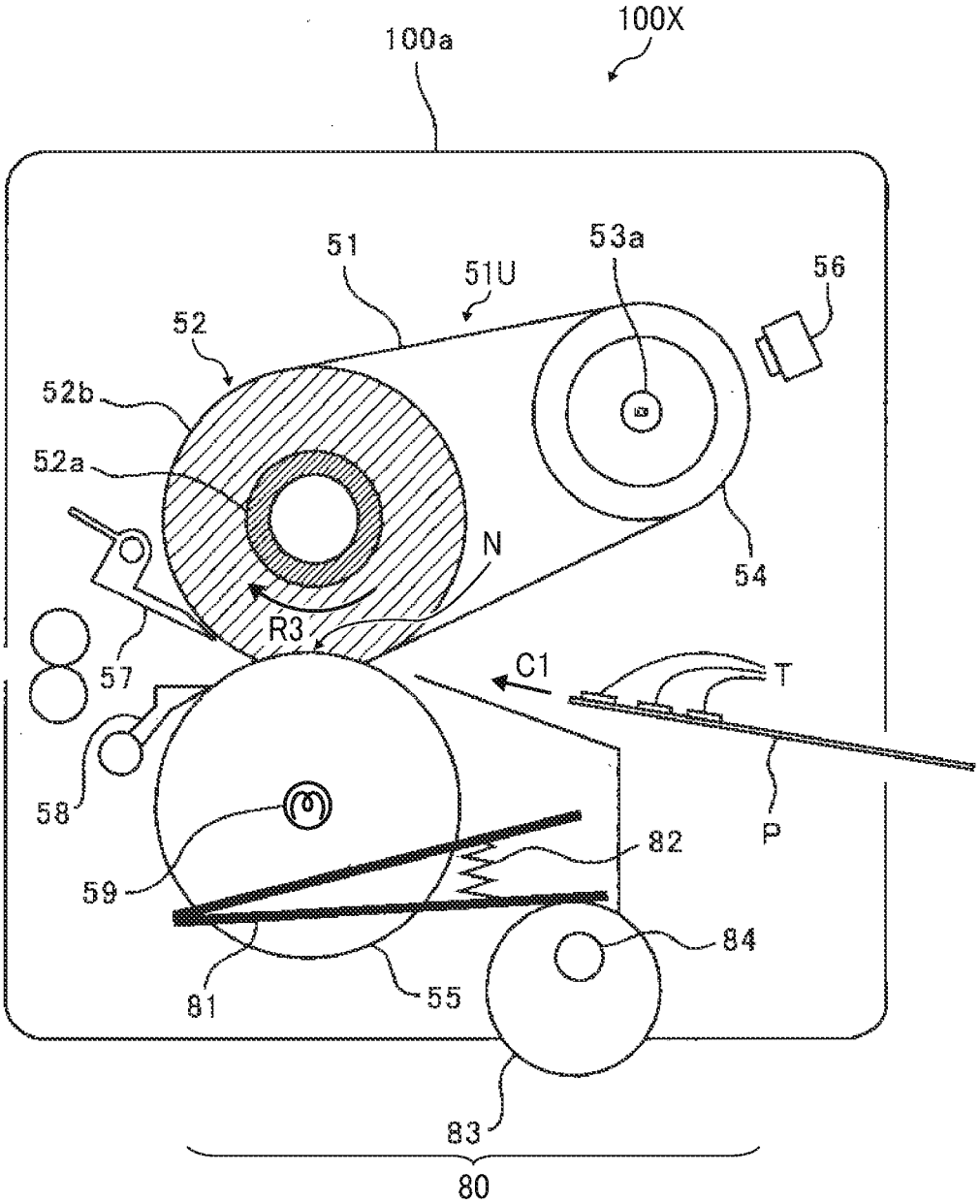
FIG. 2A is a cross-sectional view of a first example of a fixing device incorporated in the image forming apparatus of FIG. 1.
Figure 2B:
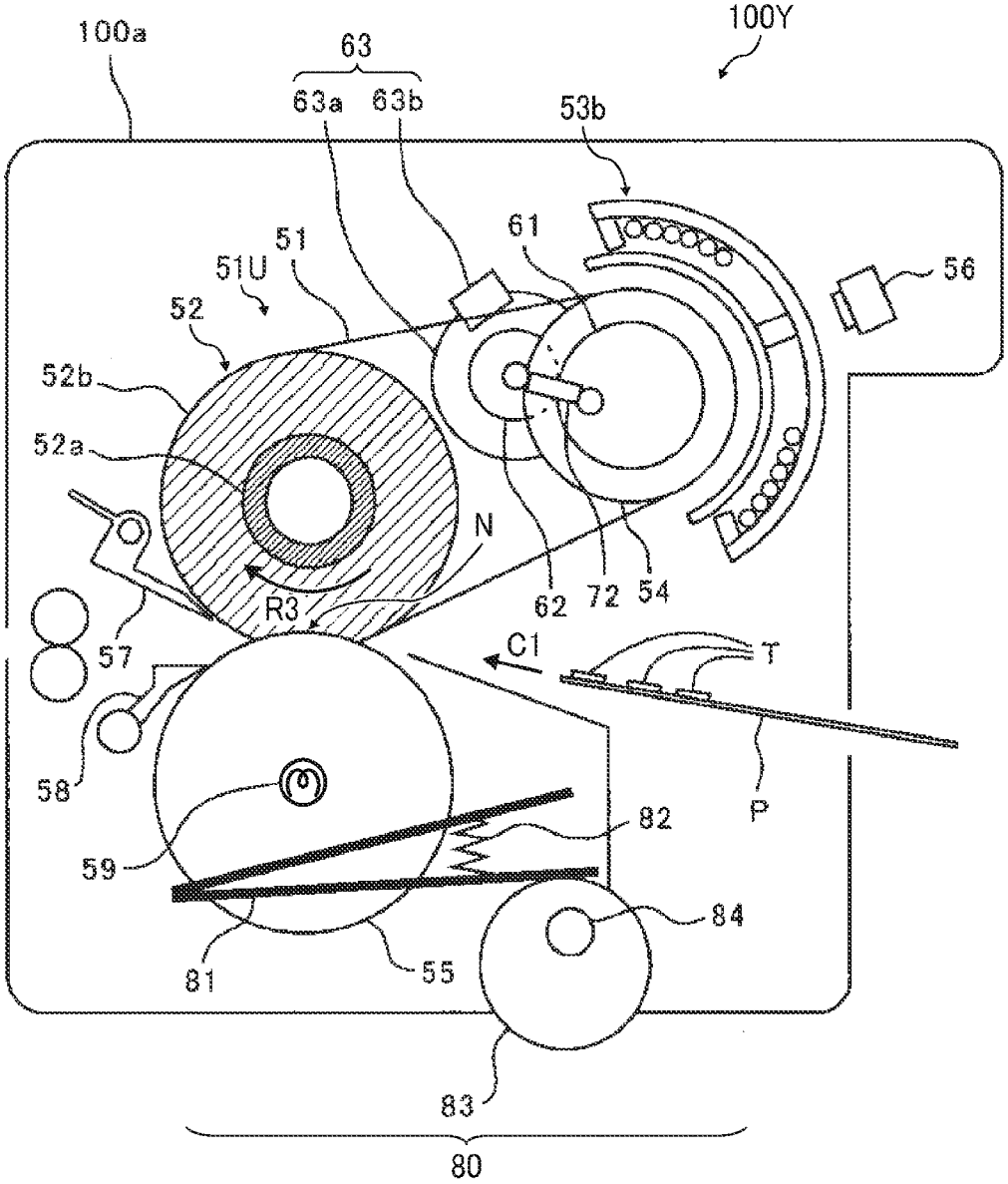
FIG. 2B is a cross-sectional view of a second example of the fixing device.

Referring now to FIGS. 2A and 2B, a description is given of examples of the fixing device 100 incorporated in the image forming apparatus 200 described above. In the present embodiment, the fixing device 100 employs a belt heating system.

FIG. 2A is a cross-sectional view of a fixing device 100X as a first example of the fixing device 100. FIG. 2B is a cross-sectional view of a fixing device 100Y as a second example of the fixing device 100.

The fixing device 100X of FIG. 2A includes a heater 53*a*, such as a halogen heater, to heat the heating roller 54. The heater 53*a* is disposed inside the heating roller 54. By contrast, the fixing device 100Y of FIG. 2B includes an induction heater 53*b* to heat the heating roller 54. The induction heater 53*b* is disposed opposite an outer circumferential surface of the fixing belt 51, which is entrained around the fixing roller 52 and the heating roller 54.

The fixing devices 100X and 100Y have identical configurations, differing only in the heater employed to heat the heating roller 54. Initially with continued reference to FIGS. 2A and 2B, a description is given of common components of the fixing devices 100X and 100Y, as components of the fixing device 100.

The fixing device 100 includes, e.g., the fixing roller 52 as a fixing rotator, the heating roller 54 as a heating rotator, the fixing belt 51, and the pressure roller 55 as a pressure rotator, inside the fixing cover 100*a*. The pressure roller 55 presses against the fixing roller 52 via the fixing belt 51, thereby forming the fixing nip N between the fixing belt 51 and the pressure roller 55.

The fixing device 100 further includes a fixing separator 57 and a pressure separator 58 disposed downstream from the fixing nip N in the sheet conveyance direction C1.

The fixing roller 52 is constructed of a metal tube 52*a* and an elastic rubber layer 52*b* coating the metal tube 52*a*. The elastic rubber layer 52*b* is made of, e.g., silicone rubber. Alternatively, the elastic rubber layer 52*b* may be made of silicone rubber foam to reduce heat absorbed into the fixing belt 51 and thereby shortening a warm-up time to warm up the fixing belt 51 to a target temperature.

The heating roller 54 is a hollow roller made of stainless steel or a nickel alloy. In the fixing device 100X of FIG. 2A, the heater 53*a* (e.g., halogen heater) is disposed inside the heating roller 54 to heat the heating roller 54. By contrast, in the fixing device 100Y of FIG. 2B, the induction heater 53*b* is disposed opposite the outer circumferential surface of the fixing belt 51, which is entrained around the fixing roller 52 and the heating roller 54. The induction heater 53*b* heats the heating roller 54 by electromagnetic induction.

The fixing belt 51 is an endless belt having a two-layer structure in cross section. Specifically, the fixing belt 51 is constructed of a base layer made of, e.g., polyimide and an elastic layer made of, e.g., silicone rubber.

The fixing belt 51 is entrained around the fixing roller 52 and the heating roller 54 with a certain tension given by a heating roller tension spring secured to the heating roller 54 and to a fixing frame. Thus, the fixing belt 51 is formed into a loop. The fixing belt 51 and the components disposed inside the loop formed by the fixing belt 51 constitute a belt unit 51U detachably coupled to the pressure roller 55.

The pressure roller 55 is a hollow roller made of, e.g., aluminum or iron. Inside the pressure roller 55 is a pressure heater 59 such as a halogen heater. The pressure roller 55 (i.e., hollow roller) has an elastic layer made of, e.g., silicone rubber as an outer circumferential layer of the pressure roller 55.

A pressure control mechanism 80 switches the pressure roller 55 between a pressure state and a pressure relief state (separation state). Specifically, the pressure control mechanism 80 moves the pressure roller 55 toward the fixing belt 51 to press the pressure roller 55 against the fixing belt 51, thereby placing the pressure roller 55 in the pressure state. On the other hand, the pressure control mechanism 80 moves the pressure roller 55 away from the fixing belt 51 to separate the pressure roller 55 from the fixing belt 51, thereby placing the pressure roller 55 in the pressure relief state (separation state).

As illustrated in FIGS. 2A and 2B, the pressure control mechanism 80 includes a pressure lever 81, a pressure spring 82, a pressure cam 83, and a pressure cam shaft 84. A drive motor rotates the pressure cam shaft 84, thereby switching between the pressure state and the pressure relief state. Specifically, the drive motor rotates the pressure cam shaft 84 to move the pressure roller 55 toward the fixing belt 51 to press the pressure roller 55 against the fixing belt 51. On the other hand, the drive motor rotates the pressure cam shaft 84 to move the pressure roller 55 away from the fixing belt 51 to separate the pressure roller 55 from the fixing belt 51.

The pressure control mechanism 80 also provides given pressure at the fixing nip N. Specifically, the drive motor adjusts a cam position of the pressure cam 83 to provide the given pressure at the fixing nip N.

When the fixing device 100 is actuated, a drive motor 95 as a driver drives and rotates the fixing roller 52 in a clockwise direction of rotation R3 as illustrated in FIG. 2. As the fixing roller 52 rotates, the fixing belt 51 rotates clockwise together with the pressure roller 55 that is pressed against the fixing roller 52 via the fixing belt 51, so as to fix a toner image T onto the sheet P and eject the sheet P bearing the fixed toner image T from the fixing nip N. Thus, the fixing roller 52 serves as a drive rotator that contacts and rotates the fixing belt 51. As the fixing belt 51 rotates, the heating roller 54 disposed inside the loop formed by the fixing belt 51 also rotates. In other words, the heating roller 54 is a driven rotator that contacts an inner circumferential surface of the fixing belt 51. Alternatively, the drive motor 95 may drive and rotate the pressure roller 55. In this case, the pressure roller 55 is a drive rotator that contacts and rotates the fixing belt 51.

With continued reference to FIGS. 2A and 2B, a description is given of a fixing operation performed by the fixing device 100. The fixing operation of the fixing device 100 starts with heating the heating roller 54. Specifically, in the fixing device 100X of FIG. 2A, the heater 53*a* disposed inside the heating roller 54 heats the heating roller 54, thereby transmitting heat from the heating roller 54 to the fixing belt 51. The heater 53*a* heats the heating roller 54 until the temperature of the fixing belt 51 detected by a thermopile 56 reaches a predetermined temperature (e.g., a temperature suitable for fixing the toner image T).

By contrast, in the fixing device 100Y of FIG. 2B, the induction heater 53*b*, disposed outside the heating roller 54, heats the heating roller 54 by electromagnetic induction, thereby transmitting heat from the heating roller 54 to the fixing belt 51. The induction heater 53*b* heats the heating roller 54 until the temperature of the fixing belt 51 detected by the thermopile 56 reaches the predetermined temperature.

The pressure heater 59, disposed inside the pressure roller 55, generates heat to heat the pressure roller 55 to a predetermined temperature when a temperature increase is required, for example. In the present embodiment, as described above, the pressure roller 55 serves as a pressure rotator. Alternatively, the pressure rotator may be an endless belt entrained around two rollers.

In the fixing device 100, while the fixing belt 51 and the pressure roller 55 are rotated, the outer circumferential surface of the fixing belt 51 is heated to the predetermined temperature to fix the toner image T onto the sheet P at the fixing nip N. Specifically, the sheet P bearing the toner image T is conveyed in the sheet conveyance direction C1 through the fixing nip N where the fixing belt 51 and the pressure roller 55 press and heat the sheet P to melt toner contained in the toner image T, thereby fixing the toner image T onto the sheet P.

The fixing separator 57 prevents sheet P bearing the fixing toner image T from wrapping around the fixing belt 51 when the sheet P is ejected from the fixing nip N. Similarly, the pressure separator 58 prevents sheet P bearing the fixing toner image T from wrapping around the pressure roller 55 when the sheet P is ejected from the fixing nip N. The sheet P thus ejected from the fixing nip N is conveyed in the sheet conveyance direction C1 along a conveyance guide.

In the fixing device 100, after the heating roller 54 is heated to a predetermined temperature and conveyance of the sheet P through the fixing device 100 is permitted, the sheet P is conveyed through the fixing nip N.

If a print job includes continuous conveyance of the sheets P, the heating roller 54 is heated continuously to supplement heat which the sheets P absorb at the fixing nip N.

The fixing belt 51 entrained around the fixing roller 52 and the heating roller 54 carries heat to the fixing nip N to fix the toner image T onto the sheet P while continuously providing heat to the fixing roller 52.

During continuous conveyance of the sheets P, the fixing roller 52 is continuously heated and thermally expanded, having an outer diameter increased from when the conveyance of the sheets P is permitted. Accordingly, the thermal expansion of the fixing roller 52 increases rotational speed (i.e., circumferential velocity, linear velocity) of the fixing belt 51. The thermal expansion of the fixing roller 52 depends on the thermal expansion coefficient of silicone rubber as an elastic body. More specifically, the thermal expansion of the fixing roller 52 depends on a representative thermal expansion coefficient of silicone rubber, which is 3.0×10E-4/° C. Accordingly, the amount of thermal expansion is substantially specified by a given heat amount per unit hour and a preset temperature. Thus, the thermal expansion of the fixing roller 52 changes the rotational speed of the fixing belt 51, thereby changing the conveyance speed of the sheet P that is conveyed through the fixing nip N.

Even if the drive motor 95 drives and rotates the pressure roller 55 instead of the fixing roller 52, thermal expansion of the pressure roller 55 increases the rotational speed of the fixing belt 51 for the same reasons as described above, in a less rate or frequency compared to the fixing device 100 in which the drive motor 95 drives and rotates the fixing roller 52. In short, thermal expansion of the fixing roller 52 or the pressure roller 55 rotated by the drive motor 95 changes the rotational speed of the fixing belt 51, thereby changing the conveyance speed of the sheet P that is conveyed through the fixing nip N.

Hence, according to the embodiments of the present disclosure, the fixing device 100 includes a rotation detector 63 and a controller 90 operatively connected to the rotation detector 63. In order to keep a predetermined conveyance speed of the sheet P that is conveyed through the fixing nip N, the controller 90 controls the rotational speed of the fixing roller 52 or the pressure roller 55 based on a rotational speed of the heating roller 54 detected by the rotation detector 63. The heating roller 54 rotates at a speed substantially the same as the rotational speed of the fixing belt 51. Accordingly, even if the radius or outer diameter of the fixing roller 52 or the pressure roller 55 rotated by the drive motor 95 changes over time or due to thermal deformation such as thermal expansion, the rotational speed of the fixing belt 51 entrained around the fixing roller 52 and the heating roller 54 is accurately detected. That is, the conveyance speed of the sheet P (i.e., recording medium) is accurately detected.

Figure 3:
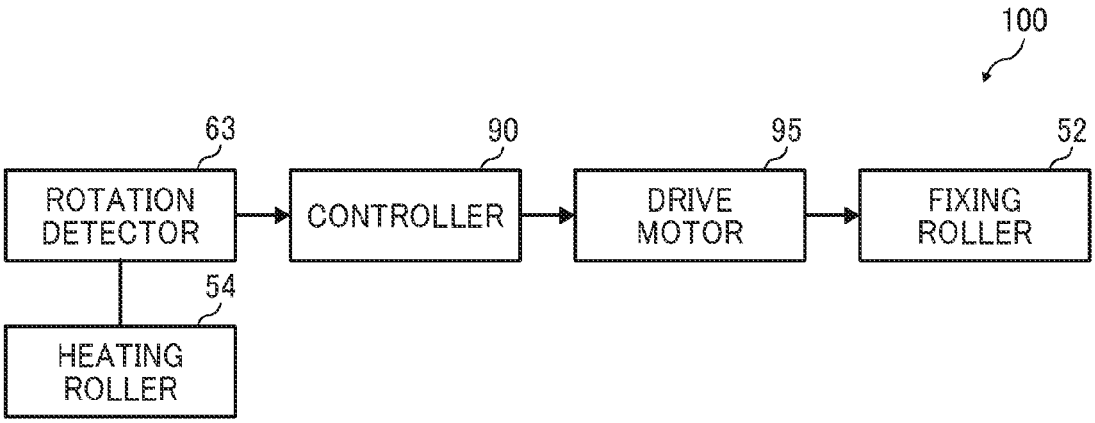
FIG. 3 is a block diagram illustrating an example of a control structure of the fixing device.

Referring now to FIG. 3, a description is given of the controller 90 and a control structure of the fixing device 100.

FIG. 3 is a block diagram illustrating an example of the control structure of the fixing device 100.

The controller 90 is a processor or circuitry implemented as a central processing unit (CPU) provided with a random access memory (RAM) and a read only memory (ROM), for example. The controller 90 may be disposed inside the fixing device 100 or the image forming apparatus 200. The controller 90 is operatively connected to the rotation detector 63 and to the drive motor 95 that drives and rotates the fixing roller 52 or the pressure roller 55. Based on the rotational speed of the heating roller 54 detected by the rotation detector 63, the controller 90 controls the drive motor 95, thereby controlling the rotational speed of the fixing roller 52 or the pressure roller 55. It is to be noted that FIG. 3 illustrates the fixing roller 52 as a rotator coupled to and rotated by the drive motor 95. Alternatively, if the drive motor 95 drives and rotates the pressure roller 55, FIG. 3 may illustrate the pressure roller 55 instead of the fixing roller 52.

Referring now to FIGS. 4A through 7, a description is given of examples of the rotation detector 63 incorporated in the fixing device 100 described above. The rotation detector 63 detects the rotational speed of the heating roller 54.

Figure 4A:
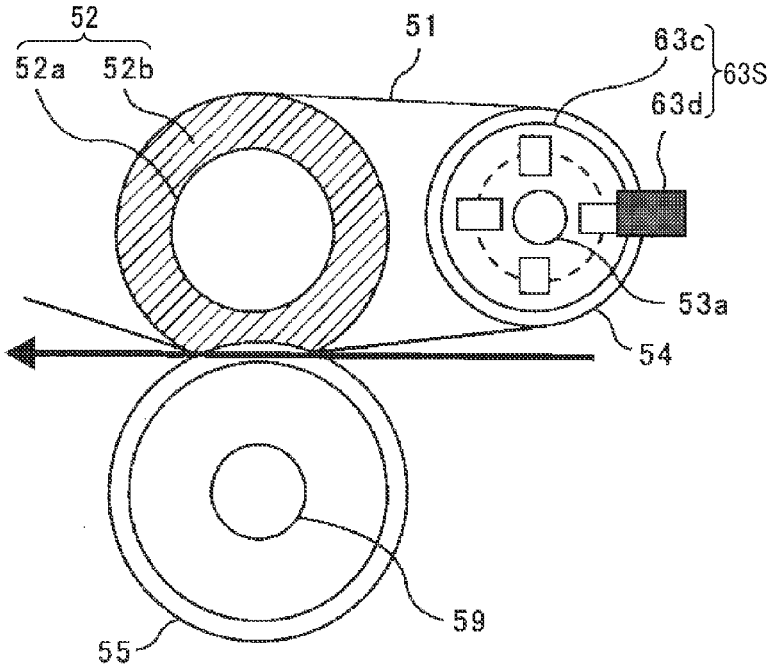
FIG. 4A is a cross-sectional view of a first example of a rotation detector incorporated in the fixing device, in a direction perpendicular to an axial direction of a heating roller incorporated in the fixing device.
Figure 4B:
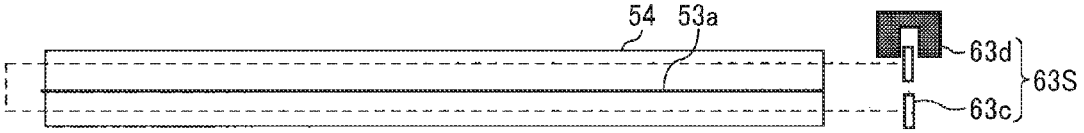
FIG. 4B is a cross-sectional view of the first example of the rotation detector in a direction parallel to the axial direction of the heating roller.

Initially with reference to FIGS. 4A and 4B, a description is given of a rotation detector 63S as a first example of the rotation detector 63 that detects the rotational speed of the heating roller 54.

FIG. 4A is a cross-sectional view of the rotation detector 63S in a direction perpendicular to a longitudinal direction of the heating roller 54, that is, in a direction perpendicular to an axial direction of the heating roller 54. FIG. 4B is a cross-sectional view of the rotation detector 63S in a direction parallel to the axial direction of the heating roller 54.

In the present example of FIGS. 4A and 4B, the heater 53*a* is used to heat the heating roller 54.

The rotation detector 63S includes a magnetic encoder 63*c* as a detected device and a magnetic sensor 63*d* as a detecting device that detects the detected device. The magnetic encoder 63*c* is disposed on a shaft of the heating roller 54. The magnetic sensor 63*d* detects existence of a magnetic portion of the magnetic encoder 63*c*. In other words, the magnetic sensor 63*d* detects the magnetic portion of the magnetic encoder 63*c* passing before the magnetic sensor 63*d*.

Specifically, as illustrated in FIG. 4A, the magnetic sensor 63*d* detects four magnetic portions of the magnetic encoder 63*c*. As illustrated in FIG. 4B, the magnetic encoder 63*c* and the magnetic sensor 63*d* are disposed on an end of the heating roller 54 in the axial direction thereof.

The number of the magnetic portions of the magnetic encoder 63*c* is not limited to four.

The construction in which the detecting device detects the detected device disposed on an end of the shaft of the heating roller 54 in the axial direction thereof is not limited to a magnetic detection system described above.

Alternatively, a slit encoder or a rotation feeler may be provided as the detected device while a photosensor may be provided as the detecting device to detect existence of a detected portion subjected to detection of the detected device. In other words, the photosensor may be provided to detect the detected portion of the detected device passing before the photosensor.

Figure 5A:
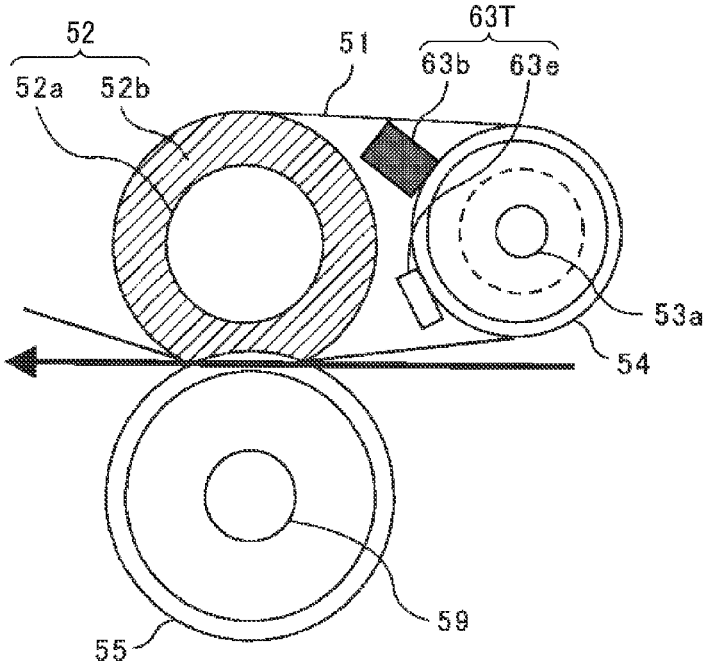
FIG. 5A is a cross-sectional view of a second example of the rotation detector in the direction perpendicular to the axial direction of the heating roller.
Figure 5B:
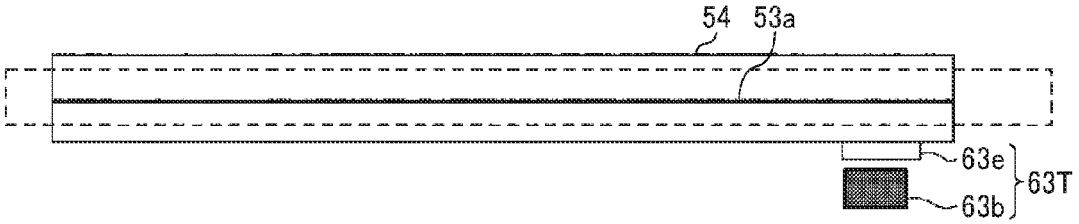
FIG. 5B is a cross-sectional view of the second example of the rotation detector in the direction parallel to the axial direction of the heating roller.

Referring now to FIGS. 5A and 5B, a description is given of a rotation detector 63T as a second example of the rotation detector 63 that detects the rotational speed of the heating roller 54.

FIG. 5A is a cross-sectional view of the rotation detector 63T in the direction perpendicular to the axial direction of the heating roller 54. FIG. 5B is a cross-sectional view of the rotation detector 63T in the direction parallel to the axial direction of the heating roller 54.

In the present example of FIGS. 5A and 5B, the heater 53*a* is used to heat the heating roller 54.

The rotation detector 63T includes a mark 63*e* as the detected device and a photosensor 63*b* as the detecting device. The mark 63*e* is disposed on an outer circumferential surface of the heating roller 54. The photosensor 63*b* detects existence of the mark 63*e*. In other words, the photosensor 63*b* detects the mark 63*e* passing before the photosensor 63*b*.

Specifically, as illustrated in FIG. 5A, the photosensor 63*b* detects the one mark 63*e* disposed on the outer circumferential surface of the heating roller 54. As illustrated in FIG. 5B, the mark 63*e* and the photosensor 63*b* are disposed on an end of the heating roller 54 in the axial direction thereof.

The number of the mark 63*e* as the detected device is not limited to one.

The construction in which the detecting device detects the detected devices disposed on an end of the shaft of the heating roller 54 in the axial direction thereof is not limited to a mark detection system described above.

Alternatively, a magnetic device may be provided as the detected device while a magnetic sensor (e.g., magnetic sensor 63*d*) may be provided as the detecting device to detect existence of the magnetic device. In other words, the magnetic sensor may be provided to detect the magnetic device passing before the magnetic sensor.

Figure 6:
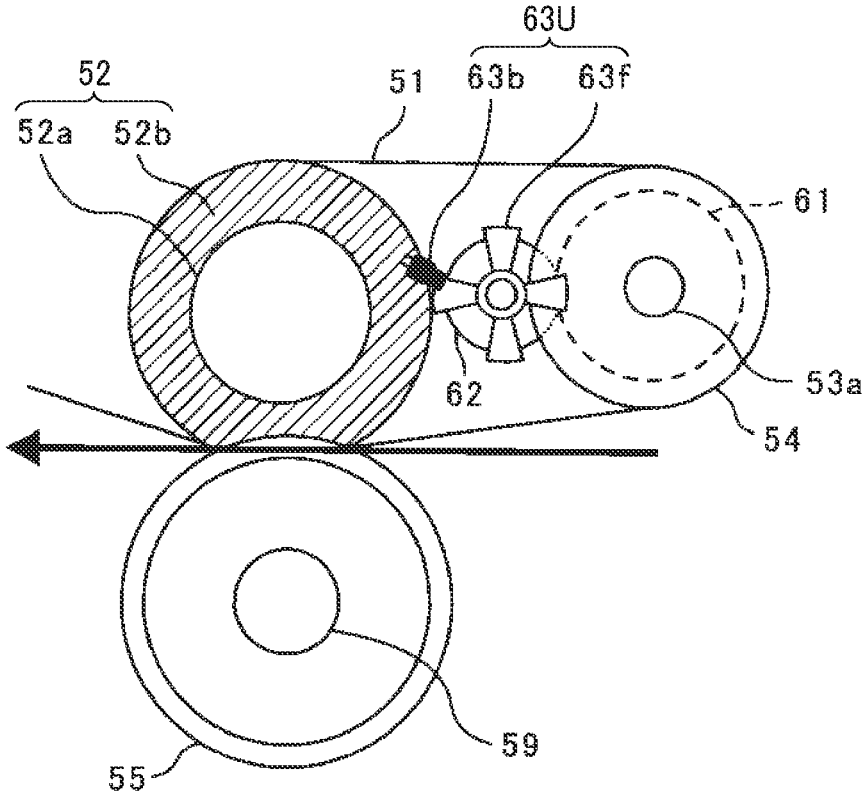
FIG. 6 is a cross-sectional view of a third example of the rotation detector in the direction perpendicular to the axial direction of the heating roller.

Referring now to FIG. 6, a description is given of a rotation detector 63U as a third example of the rotation detector 63 that detects the rotational speed of the heating roller 54.

FIG. 6 is a cross-sectional view of the rotation detector 63U in a direction perpendicular to an axial direction of the fixing roller 52, that is, in the direction perpendicular to the axial direction of the heating roller 54.

In the present example of FIG. 6, the heater 53*a* is used to heat the heating roller 54.

The rotation detector 63U includes a rotation feeler 63*f* as the detected device and the photosensor 63*b* as the detecting device. The rotation feeler 63*f* is disposed on a shaft of a rotation transferred device 62. The rotation transferred device 62 is a rotator that is rotated by a torque transmitted from the heating roller 54. The photosensor 63*b* detects the rotation feeler 63*f*.

Specifically, as illustrated in FIG. 6, a heating roller rotation transfer device 61 as a rotation transfer device is disposed on an end portion of the heating roller 54 in the axial direction thereof. The heating roller rotation transfer device 61 is, e.g., a gear that is shaped to support the heating roller 54 and that transfers the torque of the heating roller 54 to the outer circumferential surface thereof. The rotation transferred device 62 includes, e.g., a gear that meshes with the heating roller rotation transfer device 61. The rotation transferred device 62 is disposed opposite the heating roller rotation transfer device 61.

A biasing device 72, such as a tension coil spring, presses the rotation transferred device 62 against the heating roller rotation transfer device 61, as illustrated in FIG. 2B.

With the construction described above, the rotation detector 63 detects a rotational speed of the rotation transferred device 62, which rotates faster than the heating roller 54. In other words, the rotation transferred device 62 rotates at a higher rotational speed than the rotational speed of the heating roller 54. Accordingly, in addition to the rotational speed of the heating roller 54, the rotational speed of the fixing belt 51 and the conveyance speed of the sheet P are detected.

Thus, in the present example, the rotational speed of the heating roller 54 and the fixing belt 51 and the conveyance speed of the sheet P are accurately detected compared to a construction in which a rotation detector detects the rotational speed of a heating roller directly.

As described above, the rotation detector 63U includes the rotation feeler 63*f* as the detected device and the photosensor 63*b* as the detecting device. The rotation feeler 63*f* is a rotator including four feelers. The photosensor 63*b* detects interception of light by the four feelers of the rotation feeler 63*f* and light not intercepted by the four feelers of the rotation feeler 63*f*.

The rotation feeler 63*f* illustrated in FIG. 6 rotates in synchronization with rotation of the heating roller 54 at an increased speed. For a typical photosensor, the rotation feeler 63*f* rotates too fast to read. To accurately detect the rotational speed of the heating roller 54, in actuality, the number of rotation of the rotation feeler 63*f* is counted for a predetermined time unit (e.g., 10 seconds). Alternatively, if the rotation feeler 63*f* includes a divided feeler, the number of change in high/low signal may be counted.

In the present example, the duration of detection by the photosensor 63*b* of the rotation detector 63U may be determined taking into account the detection accuracy and the switching accuracy of the rotational speed of the drive motor 95 that drives and rotates the fixing roller 52 or the pressure roller 55.

For example, the duration of detection is set to about 50 seconds, for which the photosensor 63*b* detects a speed change not greater than 0.5% for feedback on the rotational speed of the drive motor 95 that drives and rotates the fixing roller 52 or the pressure roller 55.

The construction of the rotation detector 63 is not limited to the construction of the rotation detector 63U described above, which includes the rotation feeler 63*f* having the four feelers as the detected device and the photosensor 63*b* as the detecting device. For example, the number of feelers of the rotation feeler 63*f* is not limited to four.

Figure 7:
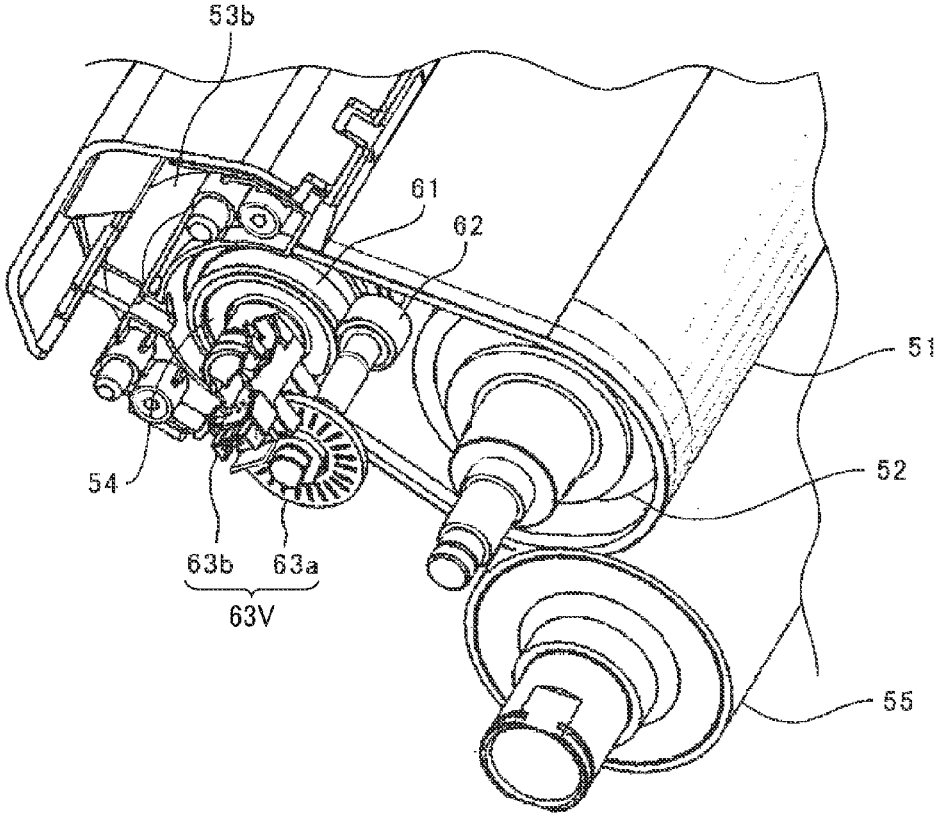
FIG. 7 is a perspective view of a fourth example of the rotation detector.

Referring now to FIG. 7, a description is given of a rotation detector 63V as a fourth example of the rotation detector 63 that detects the rotational speed of the heating roller 54.

FIG. 7 is a perspective view of the rotation detector 63V.

In the present example of FIG. 7, the induction heater 53*b* is used to heat the heating roller 54.

The rotation detector 63V includes a slit encoder 63*a* as the detected device and the photosensor 63*b* as the detecting device. The slit encoder 63*a* is disposed on the shaft of the rotation transferred device 62. As described above, the rotation transferred device 62 is a rotator that is rotated by the torque transmitted from the heating roller 54. The photosensor 63*b* detects the slit encoder 63*a*.

Specifically, like the third example described above, the heating roller rotation transfer device 61 (i.e., rotation transfer device) is disposed on the end portion of the heating roller 54 in the axial direction thereof. The heating roller rotation transfer device 61 is, e.g., a gear that is shaped to support the heating roller 54 and that transfers the torque of the heating roller 54 to the outer circumferential surface thereof. The rotation transferred device 62 includes, e.g., a gear that meshes with the heating roller rotation transfer device 61. The rotation transferred device 62 is disposed opposite the heating roller rotation transfer device 61.

The biasing device 72, such as a tension coil spring, presses the rotation transferred device 62 against the heating roller rotation transfer device 61, as illustrated in FIG. 2B.

With the construction described above, like the third example described above, the rotation detector 63 detects the rotational speed of the rotation transferred device 62, which rotates faster than the heating roller 54. In other words, the rotation transferred device 62 rotates at a higher rotational speed than the rotational speed of the heating roller 54. Accordingly, in addition to the rotational speed of the heating roller 54, the rotational speed of the fixing belt 51 and the conveyance speed of the sheet P are detected.

Thus, in the present example, the rotational speed of the heating roller 54 and the fixing belt 51 and the conveyance speed of the sheet P are accurately detected compared to the construction in which the rotation detector detects the rotational speed of the heating roller directly.

As described above, the rotation detector 63V includes the slit encoder 63*a* as the detected device and the photosensor 63*b* as the detecting device. Specifically, the slit encoder 63*a* is a rotator that includes a plurality of slits. The photosensor 63*b* detects interception of light by the plurality of slits of the slit encoder 63*a* and light not intercepted by the plurality of slits of the slit encoder 63*a*.

The slit encoder 63*a* illustrated in FIG. 7 rotates in synchronization with rotation of the heating roller 54 at an increased speed. For a typical photosensor, the slit encoder 63*a* rotates too fast to read. To accurately detect the rotational speed of the heating roller 54, in actuality, the number of rotation of the slit encoder 63*a* is counted for a predetermined time unit (e.g., 10 seconds). Alternatively, if the slit encoder 63*a* includes a divided slit, the number of change in high/low signal may be counted.

In the present example, like the third example described above, the duration of detection by the photosensor 63*b* of the rotation detector 63V may be determined taking into account the detection accuracy and the switching accuracy of the rotational speed of the drive motor 95 that drives and rotates the fixing roller 52 or the pressure roller 55.

The construction of the rotation detector 63 is not limited to the construction of the rotation detector 63V described above, which includes the slit encoder 63*a* as the detected device and the photosensor 63*b* as the detecting device.

Alternatively, the magnetic encoder 63*c* may be provided as the detected device while the magnetic sensor 63*d* may be provided to detect existence of the magnetic portion of the magnetic encoder 63*c*. In other words, the magnetic sensor 63*d* detects the magnetic portion of the magnetic encoder 63*c* passing before the magnetic sensor 63*d*.

The magnetic encoder 63*c* is smaller than the slit encoder 63*a*. Similarly, the magnetic sensor 63*d* as a reader is smaller than the photosensor 63*b*. Thus, the rotation detector 63V reduces the space for layout of internal components such as a sensor, downsizing the fixing device 100.

The rotation transferred device 62 is disposed inside the loop formed by the fixing belt 51 entrained around the fixing roller 52 and the heating roller 54. In other words, the rotation transferred device 62 is disposed opposite the inner circumferential surface of the fixing belt 51. Accordingly, an end portion of the fixing belt 51 does not come into contact the rotation transferred device 62 even though the fixing belt 51 meanders or is skewed.

With such a construction, the fixing device 100 is downsized in the axial direction of the fixing belt 51.

As described above, the controller 90 controls the rotational speed of the fixing roller 52 or the pressure roller 55 based on the rotational speed of the heating roller 54 detected by the rotation detector 63, so as to keep the predetermined conveyance speed of the sheet P that is conveyed through the fixing nip N.

Figure 8:
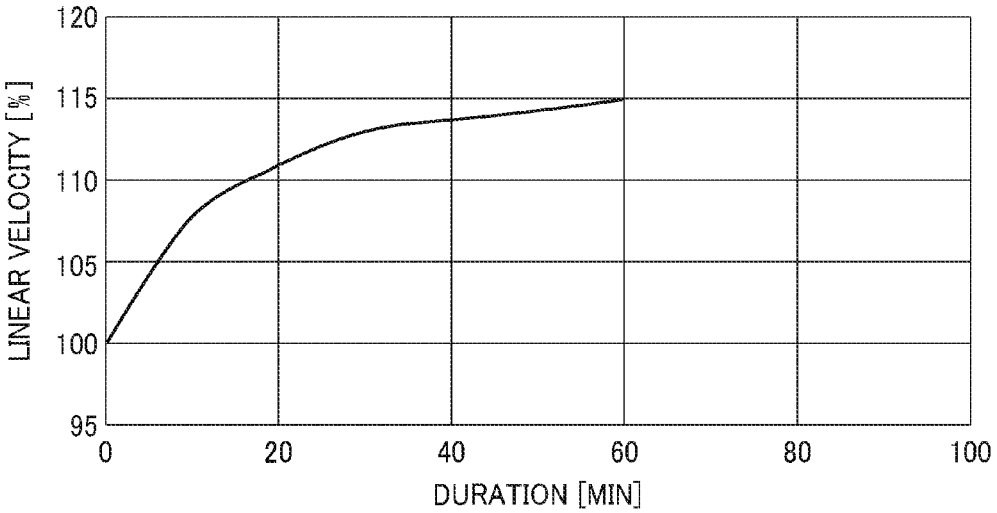
FIG. 8 is a graph illustrating a relationship between the duration of continuous conveyance of sheets and changes in linear velocity of a fixing belt incorporated in the fixing device.
Figure 9:
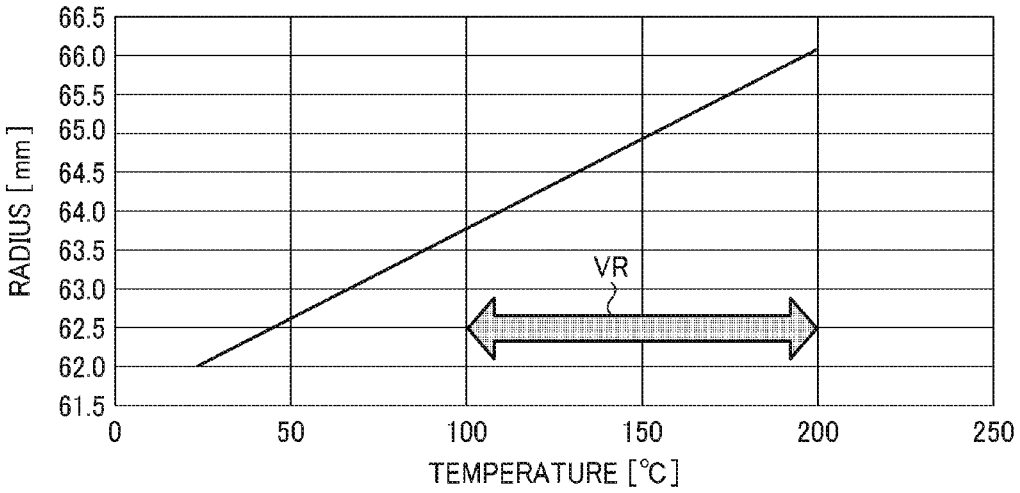
FIG. 9 is a graph illustrating a relationship between the temperature of a fixing roller incorporated in the fixing device and the radius of the fixing roller.

Referring now to FIGS. 8 and 9, a description is given of reasons for controlling the rotational speed of the fixing roller 52 or the pressure roller 55 based on the rotational speed of the heating roller 54 detected by the rotation detector 63.

FIG. 8 is a graph illustrating a relationship between changes in linear velocity of the fixing belt 51 and the duration of continuous conveyance of the sheets P to the fixing device 100 while the fixing roller 52 is rotated at a given speed.

With respect to the linear velocity of the fixing belt 51, an initial velocity is 100%.

FIG. 9 is a graph illustrating a relationship between the temperature of the fixing roller 52 and the radius of the fixing roller 52.

For example, when a drive motor (e.g., drive motor 95) that rotates a roller of the fixing device 100 maintains a constant rotational frequency, changes in the outer diameter of the fixing roller 52 due to thermal expansion increase a surface linear velocity of the fixing roller 52, further increasing a rotational speed (i.e., rotational linear velocity) of the fixing belt 51 and a rotational frequency of the heating roller 54.

If the sheets P are continuously conveyed to the fixing device 100, the linear velocity of the fixing belt 51 increases as the time elapses.

As illustrated in FIG. 9, the relationship between the temperature of the fixing roller 52 and the radius of the fixing roller 52 changes at a given gradient in a variable setting range (i.e., variable adjusting range) VR of the fixing device 100 in the image forming apparatus 200.

However, actual image forming operation (i.e., printing operation) performed by an image forming apparatus may change an outer diameter of a fixing roller and a pressure roller over time or because of, e.g., environmental changes, number of sheets for continuous printing, changes in total amount (i.e., image density) of toner images to be fixed on the sheets, or the like.

Therefore, it may be difficult to accurately maintain the predetermined rotational speed of the fixing belt based on the duration of continuous conveyance of sheets, the preset temperature of the fixing roller determined according to image forming conditions, and a detected rotational speed of the fixing roller or the pressure roller, while the relationships illustrated in FIGS. 8 and 9 are stored in advance.

On the other hand, the heating roller 54 is less influenced by the thermal expansion or changes over time because the heating roller 54 is not provided with an elastic layer such as the elastic rubber layer 52*b* of the fixing roller 52. The fixing belt 51 entrained around the fixing roller 52 and the heating roller 54 rotates at a speed substantially the same as the conveyance speed of the sheet P passing through the fixing nip N. Hence, according to the embodiments of the present disclosure, the controller 90 controls the rotational speed of the fixing roller 52 or the pressure roller 55 based on the rotational speed of the heating roller 54 detected by the rotation detector 63. Accordingly, the fixing device 100 accurately maintains the predetermined rotational speed of the fixing belt 51.

Because of the reasons described above, changes in the rotational speed (i.e., linear velocity) of the fixing belt 51 due to thermal expansion of the fixing roller 52 is perceived as changes in the rotational frequency of the heating roller 54.

In order to control rotation of the fixing belt 51 at the predetermined speed, the rotational speed of the drive motor 95 that drives and rotates the fixing roller 52 or the pressure roller 55 is adjusted based on the rotational speed (i.e., detected rotational frequency) of the heating roller 54.

Despite increasing demands for forming high quality images, typical fixing devices may cause failure as below, by controlling the rotational speed a fixing rotator (e.g., fixing roller) or a pressure rotator (e.g., pressure roller) based on the rotational speed of the pressure rotator.

For example, changes in speed of a recording medium (e.g., sheet) bearing a toner image passing through a fixing nip or changes in speed of an endless belt contacting the toner image may partially distort the toner image melting to be fixed onto the recording medium. Such distortion of the toner image during fixing operation does not satisfy the demands for forming high quality images.

Conventionally, the rotational speed of the fixing roller has been determined taking into account a range of deviation in the rotational speed of the fixing roller due to thermal expansion. However, if the distance between the transfer position (e.g., secondary transfer position) and the fixing position (i.e., fixing nip) is relatively short, the deviation in the rotational speed of, e.g., the fixing roller due to thermal expansion may not be absorbed. If the recording medium is conveyed slower than a predetermined speed at the fixing position, the recording medium may be slackened and rubbed. By contrast, if the recording medium is conveyed faster than the predetermined speed at the fixing position, the toner image may be blurred at the transfer position because the recording medium is pulled to the fixing position.

Hence, the inventors have found approaches as follows to these circumstances.

One approach (hereinafter referred to as a first approach) involves providing the fixing device 100 that changes a speed to rotate the fixing roller 52 or the pressure roller 55, that is, a rotational speed of the fixing roller 52 or the pressure roller 55, when the sheet P is not conveyed through the fixing nip N formed between the fixing belt 51 and the pressure roller 55.

Another approach (hereinafter referred to as a second approach) involves providing the fixing device 100 that controls the speed to rotate the fixing roller 52 or the pressure roller 55 (i.e., rotational speed of the fixing roller 52 or the pressure roller 55) accurately compared to comparative fixing devices. The fixing device 100 also controls the speed to rotate the fixing roller 52 or the pressure roller 55 (i.e., rotational speed of the fixing roller 52 or the pressure roller 55) so as to reduce an amount of change in the speed for each time compared to comparative fixing devices. In order to achieve such control, the fixing device 100 includes the rotation detector 63 that enhances accuracy to detect the rotational speed of the heating roller 54 compared to comparative rotation detectors.

Now, a detailed description is given of the first approach.

As described above, the fixing device 100 fixes the toner image T onto the sheet P when the sheet P is conveyed through the fixing nip N between the pressure roller 55 and the fixing belt 51 entrained around the heating roller 54 and the fixing roller 52. The controller 90 controls the speed to rotate at least one of the fixing roller 52 and the pressure roller 55 based on the rotational speed of the heating roller 54 detected by the rotation detector 63. The controller 90 changes the speed to rotate the fixing roller 52 or the pressure roller 55 when the sheet P is not conveyed through the fixing nip N, that is, when an interval between consecutive sheets P is located at the fixing nip N.

With the construction described above, the fixing device 100 has advantages as follows.

The comparative fixing devices may suffer from fixing failure, such as distortion of a toner image described above, because of the following reasons.

In the comparative fixing devices, a driving speed to rotate a drive rotator (i.e., rotational speed of a drive rotator) is controlled based on a detected rotational speed of a driven rotator. However, it is not determined when to change the driving speed.

Therefore, the driving speed is often changed so much that the toner image is distorted and fixed onto a recording medium at a fixing nip, based on the rotational speed of the driven rotator that changes in response to changes in the radius or outer diameter of the drive rotator caused by, e.g., thermal deformation such as thermal expansion.

Hence, according to the construction of the first approach described above, the fixing device 100 is timed to change the driving speed when the sheet P is not conveyed through the fixing nip N formed between the fixing belt 51 and the pressure roller 55. In other words, the controller 90 changes the speed to rotate the fixing roller 52 or the pressure roller 55 when the sheet P is not conveyed over the fixing belt 51. Since the driving speed is changed when the sheet P is not conveyed through the fixing nip N, distortion of the toner image T is prevented during fixing operation, even if the driving speed is changed so much that the toner image may be distorted during fixing operation in the comparative fixing devices.

Thus, the fixing device 100 reliably fixes the toner image T onto the sheet P, preventing fixing failure such as partial distortion of the toner image T melting to be fixed onto the sheet P.

In the fixing device 100, the drive rotator is at least one of the fixing roller 52 and the pressure roller 55. The driven rotator is the heating roller 54.

With such a construction, the fixing device 100 has advantages as follows.

The rotational speed of the fixing belt 51 may change because the radius or outer diameter of the fixing roller 52 or the pressure roller 55 driven to rotate changes over time or due to thermal deformation (e.g., thermal expansion). Therefore, if the controller 90 controls the rotational speed of the at least one of the fixing roller 52 and the pressure roller 55 based on a detected rotational speed thereof, the rotational speed of the fixing belt 51 may not be accurately controlled.

Hence, according to the construction of the first approach described above, the controller 90 controls the rotational speed of the at least one of the fixing roller 52 and the pressure roller 55 based on the rotational speed of the heating roller 54, because the radius of the heating roller 54 changes less than the radius of the fixing roller 52 or the pressure roller 55 over time or due to thermal deformation (e.g., thermal expansion). Accordingly, the rotational speed of the fixing belt 51 is accurately controlled.

The fixing device 100 further includes the pressure control mechanism 80 as a separator that separates the fixing belt 51 and the pressure roller 55 from each other.

In the fixing device 100, the controller 90 corrects the rotational speed of the heating roller 54 detected by the rotation detector 63 when the fixing belt 51 and the pressure roller 55 are separated from each other, so as to determine an initial rotational speed of the fixing roller 52 or the pressure roller 55 to convey a next sheet P through the fixing nip N.

Figure 10:
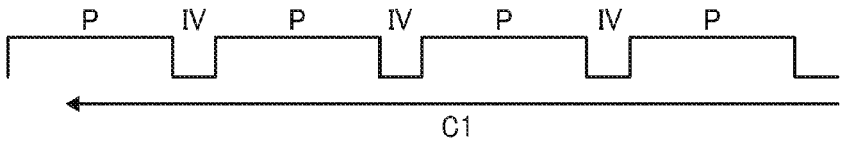
FIG. 10 is a timing chart of adjusting rotational speed.

Specifically, the controller 90 corrects the rotational speed of the heating roller 54 detected by the rotation detector 63 when an interval IV between the consecutive sheets P is located at the fixing nip N as illustrated in FIG. 10, so as to determine the initial rotational speed of the fixing roller 52 or the pressure roller 55 to convey the next sheet P through the fixing nip N. FIG. 10 is a timing chart of adjusting rotational speed.

Accordingly, the fixing device 100 has advantages as follows.

When the fixing belt 51 and the pressure roller 55 are separated from each other, such as in a standby mode, there is no immediately previous recording medium conveyed. Therefore, in the comparative fixing devices, the drive rotator rotates at a fixed initial rotational speed to convey a recording medium through the fixing nip. That is, the drive rotator does not rotate at a target speed.

In the comparative fixing devices, the fixed rotational speed is determined regardless of changes in the radius of the drive rotator due to, e.g., thermal deformation. Therefore, even if the rotational speed of the drive rotator is controlled based on the rotational speed of the driven rotator detected by the rotation detector, the drive rotator may not rotate at an appropriate speed when the recording medium is conveyed through the fixing nip.

Hence, according to the construction of the first approach described above, the controller 90 corrects the rotational speed of the heating roller 54 detected by the rotation detector 63 when the fixing belt 51 and the pressure roller 55 are separated from each other, so as to determine the initial rotational speed of the fixing roller 52 or the pressure roller 55 to convey the next sheet P through the fixing nip N.

In addition, before the above described correction, a difference between a contact state and a separation state is measured in the same thermal expansion rate, and thus is obtained for appropriate correction. Based on the rotational speed of the heating roller 54 appropriately corrected, the initial rotational speed of the fixing roller 52 or the pressure roller 55 is determined.

Accordingly, from the separation state, such as the standby mode, in which the fixing belt 51 and the pressure roller 55 are separated from each other, the initial rotational speed to convey the next sheet P through the fixing nip N is determined depending on the changes in the radius of the fixing roller 52 or pressure roller 55 driven to rotate. That is, the fixing roller 52 or pressure roller 55 rotates at an appropriate speed when the sheet P is conveyed through the fixing nip N.

The fixing device 100 further includes the rotation transferred device 62 rotated by the torque from the heating roller 54. The rotation detector 63 includes a detected device (e.g., rotation feeler 630 and a detecting device (e.g., photosensor 63*b*) to detect the detected device. The detected device is disposed on one of the heating roller 54, the shaft of the heating roller 54, and the shaft of the rotation transferred device 62.

With such a construction, the fixing device 100 has advantages as follows.

Since the heating roller 54 is in contact with the fixing belt 51, the rotation detector 63 that detects the rotational speed of the heating roller 54 also detects the rotational speed of the fixing belt 51 and abnormality of the fixing belt 51 resulting from damage to the fixing belt 51.

In some embodiments, the rotation detector 63 may include the mark 63*e* and the photosensor 63*b* to detect the mark, more specifically, to detect existence of the mark. The mark 63*e* is disposed on one of the heating roller 54, the shaft of the heating roller 54, and the shaft of the rotation transferred device 62.

Accordingly, the fixing device 100 accurately detects the rotational speed of the heating roller 54.

Alternatively, the rotation detector 63 may include the slit encoder 63*a* and the photosensor 63*b* that detects the slit encoder 63*a*.

The rotation detector 63 that includes the slit encoder 63*a* and the photosensor 63*b* is downsized compared to the comparative rotation detectors. Accordingly, the fixing device 100 incorporating the downsized rotation detector 63 is also downsized compared to the comparative fixing devices.

Alternatively, the rotation detector 63 may include the magnetic encoder 63*c* and the magnetic sensor 63*d* that detects the magnetic encoder 63*c*.

The rotation detector 63 that includes the magnetic encoder 63*c* and the magnetic sensor 63*d* accurately detects the rotational speed of the heating roller 54 even though the fixing belt 51 meanders or is skewed. The fixing device 100 incorporating the rotation detector 63 is downsized compared to the comparative fixing devices.

Now, a detailed description is given of the second approach.

As described above, the fixing device 100 fixes the toner image T onto the sheet P when the sheet P is conveyed through the fixing nip N between the pressure roller 55 and the fixing belt 51 entrained around the heating roller 54 and the fixing roller 52. The controller 90 controls the speed to rotate the fixing roller 52 or the pressure roller 55 based on the rotational speed of the heating roller 54 detected by the rotation detector 63.

In addition, as described above in the third and fourth examples, the fixing device 100 includes the heating roller rotation transfer device 61 and the rotation transferred device 62. The heating roller rotation transfer device 61 is disposed on an end portion of the heating roller 54 in the axial direction thereof to support the heating roller 54 and transmits the torque of the heating roller 54 to the rotation transferred device 62 disposed opposite the heating roller rotation transfer device 61. The fixing device 100 further includes the biasing device 72 that biases the rotation transferred device 62 toward the heating roller rotation transfer device 61.

The controller 90 changes the speed to rotate the fixing roller 52 or the pressure roller 55 based on the rotational speed of the heating roller 54 detected by the rotation detector 63 disposed on the shaft of the rotation transferred device 62.

With the construction described above, the fixing device 100 has advantages as follows.

The comparative fixing devices may suffer from fixing failure, such as distortion of the toner image described above, because of the following reasons, in addition to the reasons described above.

In the comparative fixing devices, the rotation detector directly detects rotational conditions of the driven rotator. Such direct detection is not accurate enough to satisfy recent demands for forming high quality images. In addition, the detection is not frequently performed.

Therefore, an increased amount of the driving speed to rotate the drive rotator is changed for each time, resulting in distortion of the toner image during fixing operation.

Hence, according to the construction of the second approach described above, the fixing device 100 includes the heating roller rotation transfer device 61, the rotation transferred device 62, and the rotation detector 63. The heating roller rotation transfer device 61 is disposed on the heating roller 54 to transmit the torque of the heating roller 54 to the rotation transferred device 62. The rotation detector 63 is disposed on the rotation transferred device 62. The rotation transferred device 62 is rotatable faster than the heating roller 54. In other words, the rotation transferred device 62 is rotatable at a higher rotational speed than the rotational speed of the heating roller 54. Accordingly, the fixing device 100 detects the rotational speed of the heating roller 54 accurately and frequently compared to the comparative fixing devices. In addition, the fixing device 100 controls the rotational speed of the fixing belt 51 accurately and frequently compared to the comparative fixing devices, according to the relationship between the rotational speed of the fixing belt 51 and the rotational speed of the heating roller 54 that changes due to, e.g., thermal deformation of the fixing roller 52.

Accordingly, a reduced amount of the driving speed is changed for each time to prevent distortion of the toner image during fixing operation, even if the driving speed is changed when the sheet P is conveyed through the fixing nip N.

Thus, the fixing device 100 reliably fixes the toner image T onto the sheet P, preventing fixing failure such as partial distortion of the toner image T melting to be fixed onto the sheet P.

Since the controller 90 controls the speed to rotate at least one of the fixing roller 52 and the pressure roller 55 accurately compared to the comparative fixing devices, the fixing device 100 prevents the recording medium from being slackened and rubbed. The fixing device 100 also prevents the toner image from being blurred at the transfer position, which may be caused by the recording medium pulled to the fixing position.

As illustrated in FIGS. 6 and 7 referred to describe the third and fourth examples, respectively, the rotation transferred device 62 is disposed inside the loop formed by the fixing belt 51. In other words, the rotation transferred device 62 is disposed opposite the inner circumferential surface of the fixing belt 51.

Accordingly, the fixing device 100 is downsized.

The image forming apparatus 200 includes the fixing device 100 according to the first approach or the second approach described above.

Accordingly, the image forming apparatus 200 has advantages similar to the advantages of the fixing device 100 according to the first approach or the second approach described above.

The present disclosure has been described above with reference to specific embodiments. Specific constructions are not limited to the construction of the image forming apparatus 200 provided with the fixing device 100 of the embodiments described above, but various modifications and enhancements are possible without departing from the scope of the present disclosure.

For example, the components of the image forming apparatus may have any constructions. For example, in the image forming apparatus employing a tandem structure, a plurality of process cartridges (i.e., image forming devices) may be aligned in any order. The image forming apparatus is not limited to an image forming apparatus employing the tandem structure. Alternatively, the image forming apparatus may have a plurality of developing devices disposed around one photoconductor, or may have a revolver developing device. The image forming apparatus is not limited to an image forming apparatus employing toner of four colors. Alternatively, the image forming apparatus may be a full-color machine employing toner of three colors, a multicolor machine employing toner of two colors, or a monochrome machine that forms a monochrome image. The image forming apparatus is not limited to a printer. Alternatively, the image forming apparatus may be a copier, a facsimile machine, or a multifunction peripheral (MFP) having at least one of copying, printing, scanning, facsimile, and plotter functions.

Although specific embodiments and examples are described, the embodiments and examples according to the present disclosure are not limited to those specifically described herein. Several aspects of the fixing device are exemplified as follows.

A description is now given of an aspect A of the fixing device.

A fixing device (e.g., fixing device 100) includes a heating rotator (e.g., heating roller 54), a fixing rotator (e.g., fixing roller 52), an endless belt (e.g., fixing belt 51), a pressure rotator (e.g., pressure roller 55), a rotation detector (e.g., rotation detector 63), and circuitry (e.g., controller 90). The endless belt is entrained around the heating rotator and the fixing rotator. The pressure rotator presses against the endless belt to form a fixing nip (e.g., fixing nip N) between the pressure rotator and the endless belt. When a recording medium (e.g., sheet P) bearing a toner image (e.g., toner image T) is conveyed through the fixing nip, the toner image is fixed onto the recording medium. The rotation detector detects a rotational speed of a driven rotator (e.g., heating roller 54) that contacts an inner circumferential surface of the endless belt. The circuitry is operatively connected to the rotation detector to control a rotational speed of a drive rotator (e.g., fixing roller 52, pressure roller 55) that contacts and rotates the endless belt, based on the rotational speed of the driven rotator detected by the rotation detector. The circuitry changes the rotational speed of the drive rotator when the recording medium is not conveyed over the endless belt, that is, when the recording medium is not conveyed through the fixing nip.

Accordingly, the fixing device has some or all of the following advantages, enumeration of which is not exhaustive or limiting.

The comparative fixing devices may suffer from fixing failure, such as distortion of a toner image described above, because of the following reasons.

In the comparative fixing devices, a driving speed to rotate a drive rotator is controlled based on a detected rotational speed of a driven rotator. However, it is not determined when to change the driving speed.

Therefore, the driving speed is often changed so much that the toner image is distorted and fixed onto a recording medium at a fixing nip, based on the rotational speed of the driven rotator that changes in response to changes in the radius or outer diameter of the drive rotator caused by, e.g., thermal deformation such as thermal expansion.

Hence, according to the present aspect, the fixing device is timed to change the driving speed when the recording medium is not conveyed through the fixing nip formed between the endless belt and the pressure rotator. In other words, the circuitry changes the rotational speed of the drive rotator when the recording medium is not conveyed over the endless belt. Since the driving speed is changed when the recording medium is not conveyed through the fixing nip, distortion of the toner image is prevented during fixing operation, even if the driving speed is changed so much that the toner image may be distorted during fixing operation in the comparative fixing devices.

Accordingly, the fixing device reliably fixes the toner image onto the recording medium, preventing fixing failure such as partial distortion of the toner image melting to be fixed onto the recording medium.

A description is now given of an aspect B of the fixing device.

In the fixing device according to the aspect A, the drive rotator is at least one of the fixing rotator and the pressure rotator. The driven rotator is the heating rotator.

Accordingly, the fixing device has some or all of the following advantages, enumeration of which is not exhaustive or limiting.

The rotational speed of the endless belt may change because the radius or outer diameter of the fixing rotator or the pressure rotator driven to rotate changes over time or due to thermal deformation (e.g., thermal expansion). Therefore, if the circuitry controls the rotational speed of the at least one of the fixing rotator and the pressure rotator based on a detected rotational speed thereof, the rotational speed of the endless belt may not be accurately controlled.

Hence, according to the present aspect, the circuitry controls the rotational speed of the at least one of the fixing rotator and the pressure rotator based on the rotational speed of the heating rotator, because the radius of the heating rotator changes less than the radius of the fixing rotator or the pressure rotator over time or due to thermal deformation (e.g., thermal expansion). Accordingly, the rotational speed of the fixing belt is accurately controlled.

A description is now given of an aspect C of the fixing device.

According to the aspect A or B, the fixing device further includes a separator (e.g., pressure control mechanism 80) that separates the fixing belt and the pressure rotator from each other. In the fixing device, the circuitry corrects the rotational speed of the driven rotator detected by the rotation detector when the endless belt and the pressure rotator are separated from each other, so as to determine an initial rotational speed of the drive rotator to convey a next recording medium through the fixing nip.

Accordingly, the fixing device has some or all of the following advantages, enumeration of which is not exhaustive or limiting.

When the endless belt and the pressure rotator are separated from each other, such as in a standby mode, there is no immediately previous recording medium conveyed. Therefore, in the comparative fixing devices, the drive rotator rotates at a fixed initial rotational speed to convey a recording medium through the fixing nip. That is, the drive rotator does not rotate at a target speed.

In the comparative fixing devices, the fixed rotational speed is determined regardless of changes in the radius of the drive rotator due to, e.g., thermal deformation. Therefore, even if the rotational speed of the drive rotator is controlled based on the rotational speed of the driven rotator detected by the rotation detector, the drive rotator may not rotate at an appropriate speed when the recording medium is conveyed through the fixing nip.

Hence, according to the present aspect, the circuitry corrects the rotational speed of the driven rotator detected by the rotation detector when the fixing belt and the pressure rotator are separated from each other, so as to determine the initial rotational speed of the drive rotator to convey the next recording medium through the fixing nip.

In addition, before the above described correction, a difference between a contact state and a separation state is measured in the same thermal expansion rate, and thus is obtained for appropriate correction. Based on the rotational speed of the driven rotator appropriately corrected, the initial rotational speed of the drive rotator is determined.

Accordingly, from the separation state, such as the standby mode, in which the endless belt and the pressure rotator are separated from each other, the initial rotational speed to convey the next recording medium through the fixing nip is determined depending on the changes in the radius of the drive rotator. That is, the drive rotator rotates at an appropriate speed when the recording medium is conveyed through the fixing nip.

A description is now given of an aspect D of the fixing device.

According to any one of the aspects A through C, the fixing device further includes a rotation transferred device (e.g., rotation transferred device 62) rotated by a torque from the driven rotator. The rotation detector includes a detected device (e.g., rotation feeler 630 and a detecting device (e.g., photosensor 63*b*) to detect the detected device. The detected device is disposed on one of the driven rotator, a shaft of the driven rotator, and a shaft of the rotation transferred device.

Accordingly, the fixing device has some or all of the following advantages, enumeration of which is not exhaustive or limiting.

Since the driven rotator is in contact with the endless belt, the rotation detector that detects the rotational speed of the driven rotator also detects the rotational speed of the endless belt and abnormality of the endless belt resulting from damage to the endless belt.

A description is now given of an aspect E of the fixing device.

According to any one of the aspects A through D, the fixing device further includes a rotation transferred device (e.g., rotation transferred device 62) rotated by a torque from the driven rotator. The rotation detector includes a mark (e.g., mark 63*e*) and a detecting device (e.g., photosensor 63*b*) to detect the mark, more specifically, to detect existence of the mark. The mark is disposed on one of the driven rotator, a shaft of the driven rotator, and a shaft of the rotation transferred device.

Accordingly, as described above, the fixing device accurately detects the rotational speed of the driven rotator.

A description is now given of an aspect F of the fixing device.

According to any one of the aspects A through E, the rotation detector includes a slit encoder (e.g., slit encoder 63*a*) and a photosensor (e.g., photosensor 63*b*) to detect the slit encoder.

Accordingly, as described above, the rotation detector is downsized compared to the comparative rotation detectors. The fixing device incorporating the downsized rotation detector is also downsized compared to the comparative fixing devices.

A description is now given of an aspect G of the fixing device.

According to any one of the aspects A through E, the rotation detector includes a magnetic encoder (e.g., magnetic encoder 63*c*) and a magnetic sensor (e.g., magnetic sensor 63*d*) to detect the magnetic encoder.

Accordingly, as described above, the rotation detector accurately detects the rotational speed of the driven rotator even though the endless belt meanders or is skewed. The fixing device incorporating the rotation detector is downsized compared to the comparative fixing devices.

A description is now given of an aspect H of the fixing device.

A fixing device (e.g., fixing device 100) includes a heating rotator (e.g., heating roller 54), a fixing rotator (e.g., fixing roller 52), an endless belt (e.g., fixing belt 51), a pressure rotator (e.g., pressure roller 55), a rotation detector (e.g., rotation detector 63), circuitry (e.g., controller 90), a rotation transfer device (e.g., heating roller rotation transfer device 61), a rotation transferred device (e.g., rotation transferred device 62), and a biasing device (e.g., biasing device 72). The endless belt is entrained around the heating rotator and the fixing rotator. The pressure rotator presses against the endless belt to form a fixing nip (e.g., fixing nip N) between the pressure rotator and the endless belt. When a recording medium (e.g., sheet P) bearing a toner image (e.g., toner image T) is conveyed through the fixing nip, the toner image is fixed onto the recording medium. The rotation detector detects a rotational speed of a driven rotator (e.g., heating roller 54) that contact an inner circumferential surface of the endless belt. The circuitry is operatively connected to the rotation detector to control a rotational speed of a drive rotator (e.g., fixing roller 52, pressure roller 55) that contacts and rotates the endless belt, based on the rotational speed of the driven rotator detected by the rotation detector. The rotation transfer device is disposed on an end portion of the driven rotator in an axial direction of the driven rotator. The rotation transferred device is disposed opposite the rotation transfer device. The rotation transfer device transmits a torque of the driven rotator to the rotation transferred device. The biasing device biases the rotation transferred device toward the rotation transfer device. The rotation detector is disposed on a shaft of the rotation transferred device. The circuitry changes the speed to rotate the drive rotator (i.e., rotational speed of the drive rotator) based on the rotational speed of the driven rotator detected by the rotation detector.

Accordingly, the fixing device has some or all of the following advantages, enumeration of which is not exhaustive or limiting.

The comparative fixing devices may suffer from fixing failure, such as distortion of the toner image described above, because of the following reasons, in addition to the reasons described above.

In the comparative fixing devices, the rotation detector directly detects rotational conditions of the driven rotator. Such direct detection is not accurate enough to satisfy recent demands for forming high quality images. In addition, the detection is not frequently performed.

Therefore, an increased amount of the driving speed to rotate the drive rotator is changed for each time, resulting in distortion of the toner image during fixing operation.

Hence, according to the present aspect, the fixing device includes the rotation transfer device, the rotation transferred device, and the rotation detector. The rotation transfer device is disposed on the driven rotator to transmit the torque of the driven rotator to the rotation transferred device. The rotation detector is disposed on the rotation transferred device. The rotation transferred device is rotatable faster than the driven rotator. In other words, the rotation transferred device is rotatable at a higher rotational speed than the rotational speed of the driven rotator. Accordingly, the fixing device detects the rotational speed of the driven rotator accurately and frequently compared to the comparative fixing devices. In addition, the fixing device controls the rotational speed of the endless belt accurately and frequently compared to the comparative fixing devices, according to the relationship between the rotational speed of the endless belt and the rotational speed of the driven rotator that changes due to, e.g., thermal deformation of the drive rotator.

Accordingly, a reduced amount of the driving speed is changed for each time to prevent distortion of the toner image during fixing operation, even if the driving speed is changed when the recording medium is conveyed through the fixing nip.

Accordingly, the fixing device reliably fixes the toner image onto the recording medium, preventing fixing failure such as partial distortion of the toner image melting to be fixed onto the recording medium.

A description is now given of an aspect I of the fixing device.

According to the aspects H, the rotation transferred device is disposed opposite the inner circumferential surface of the endless belt.

Accordingly, as described above, the fixing device is downsized.

A description is now given of an aspect J of the fixing device.

An image forming apparatus (e.g., image forming apparatus 200) includes the fixing device according to any one of the aspects A through I described above.

Accordingly, the image forming apparatus has advantages similar to the advantages of the fixing device according to any one of the aspects A through I described above.

Although the present disclosure makes reference to specific embodiments, it is to be noted that the present disclosure is not limited to the details of the embodiments described above and various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

Any one of the above-described operations may be performed in various other ways, for example, in an order different from that described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored in any kind of storage medium. Examples of storage mediums include, but are not limited to, flexible disk, hard disk, optical discs, magneto-optical discs, magnetic tapes, non-volatile memory cards, read only memory (ROM), etc.

Alternatively, any one of the above-described and other methods of the present disclosure may be implemented by an application specific integrated circuit (ASIC), prepared by interconnecting an appropriate network of conventional component circuits or by a combination thereof with one or more conventional general purpose microprocessors and/or signal processors programmed accordingly.

What is claimed is:

1. A fixing device comprising:

an endless belt;

a drive rotator to contact and rotate the endless belt;

a driven rotator to contact an inner circumferential surface of the endless belt, a rotation detector to detect a rotational speed of the driven rotator; and circuitry operatively connected to the rotation detector to control a rotational speed of the drive rotator based on the rotational speed of the driven rotator detected by the rotational detector, the circuitry configured to determine a speed change value of the driven rotator, to determine a timing of when a non-sheet interval between consecutive sheets of a print job is located at a fixing nip of the drive rotator, and to apply a change in the rotational speed of the drive rotator during the non-sheet interval, wherein the change in the rotational speed applied to the drive rotator is based on the speed change value of the driven rotator.

2. The fixing device according to claim 1, wherein the drive rotator is at least one of a fixing rotator and a pressure rotator, and wherein the driven rotator is a heating rotator.

3. The fixing device according to claim 2, wherein each of the fixing rotator and the heating rotator is a roller.

4. The fixing device according to claim 2, wherein the pressure rotator is one of a roller and a belt.

5. The fixing device according to claim 2, wherein the endless belt is entrained around the heating rotator and the fixing rotator, and wherein the pressure rotator presses against the endless belt to form a fixing nip between the pressure rotator and the endless belt, through which a recording medium bearing a toner image is conveyed.

6. The fixing device according to claim 2, further comprising a separator to separate the endless belt and the pressure rotator from each other, wherein the circuitry corrects the rotational speed of the driven rotator detected by the rotation detector when the endless belt and the pressure rotator are separated from each other, to determine an initial rotational speed of the drive rotator to convey a next recording medium over the endless belt.

7. The fixing device according to claim 1, further comprising a rotation transferred device rotated by a torque from the driven rotator, wherein the rotation detector includes:

a detected device disposed on one of the driven rotator, a shaft of the driven rotator, and a shaft of the rotation transferred device; and a detecting device to detect the detected device.

8. The fixing device according to claim 1, further comprising a rotation transferred device rotated by a torque from the driven rotator, wherein the rotation detector includes:

a mark disposed on one of the driven rotator, a shaft of the driven rotator, and a shaft of the rotation transferred device; and a detecting device to detect the mark.

9. The fixing device according to claim 1, wherein the rotation detector includes:

a slit encoder; and a photosensor to detect the slit encoder.

10. The fixing device according to claim 1, wherein the rotation detector includes:

a magnetic encoder; and a magnetic sensor to detect the magnetic encoder.

11. A fixing device comprising:

an endless belt;

a drive rotator to contact and rotate the endless belt;

a driven rotator to contact an inner circumferential surface of the endless belt, a rotation detector to detect a rotational speed of the driven rotator;

circuitry to control a rotational speed of the drive rotator based on the rotational speed of the driven rotator detected by the rotation detector;

a rotation transfer device disposed on an end portion of the driven rotator in an axial direction of the driven rotator;

a rotation transferred device disposed opposite the rotation transfer device; and a biasing device to bias the rotation transferred device toward the rotation transfer device, the rotation transfer device transmitting a torque of the driven rotator to the rotation transferred device, the rotation detector disposed on a shaft of the rotation transferred device, the circuitry configured to determine a speed change value of the driven rotator, to determine a timing of when a non-sheet interval between consecutive sheets of a print job is located at a fixing nip of the drive rotator, and to apply a change in the rotational speed of the drive rotator during the non-sheet interval, wherein the change in the rotational speed applied to the drive rotator is based on the speed change value of the driven rotator.

12. The fixing device according to claim 11, wherein the rotation transferred device is disposed opposite the inner circumferential surface of the endless belt.

13. The fixing device according to claim 11, wherein the drive rotator is at least one of a fixing rotator and a pressure rotator, and wherein the driven rotator is a heating rotator.

14. The fixing device according to claim 13, wherein each of the fixing rotator and the heating rotator is a roller.

15. The fixing device according to claim 13, wherein the pressure rotator is one of a roller and a belt.

16. The fixing device according to claim 13, wherein the endless belt is entrained around the heating rotator and the fixing rotator, and wherein the pressure rotator presses against the endless belt to form a fixing nip between the pressure rotator and the endless belt, through which a recording medium bearing a toner image is conveyed.

17. An image forming apparatus comprising the fixing device according to claim 1.

18. An image forming apparatus comprising the fixing device according to claim 11.

* * * * *